US005211294A

United States Patent [19]

Garman

[11] Patent Number: 5,211,294

[45] Date of Patent: May 18, 1993

[54] TILESETTERS TRAY

[75] Inventor: Michael G. Garman, Morro Bay, Calif.

[73] Assignee: Tile Master Tools, a California General Partnership, Morro Bay, Calif.

[21] Appl. No.: 844,534

[22] Filed: Mar. 2, 1992

[51] Int. Cl.[5] ..... A47F 7/00

[52] U.S. Cl. ..... 211/70.6; 248/213.2

[58] Field of Search ..... 211/70.6, 126, 65; 248/213.2, 113; 15/264

[56] References Cited

U.S. PATENT DOCUMENTS

| | | | |
|---|---|---|---|
| 1,292,980 | 1/1919 | Fry | 248/213.2 |
| 1,517,164 | 4/1964 | Lear | 15/264 |
| 1,570,892 | 1/1926 | Hill | 15/264 |
| 1,848,450 | 3/1932 | Williamson | 15/264 |
| 4,846,076 | 7/1989 | Menges, Sr. et al. | 248/213.2 X |

*Primary Examiner*—Blair M. Johnson
*Attorney, Agent, or Firm*—Daniel C. McKown

[57] ABSTRACT

A tray for use by a tilesetter to organize his tools and materials so as to keep the work area uncluttered and so as to keep each of the tools and materials in a known location so that they are immediately available for use, includes a number of receptacles in which the tools and materials are kept. The bottoms of the deepest receptacles lie in a common plane, which enables the tray to rest stably on a flat surface such as a floor or a counter top. The crescent shaped tray also includes a skirt that depends from the concave edge of the tray. The tray may be mounted on a bucket and is retained securely thereon because the rim of the bucket extends into the space between the skirt and one or more of the receptacles.

3 Claims, 2 Drawing Sheets

TILESETTERS TRAY

BACKGROUND OF THE INVENTION

The present invention is in the field of organizers, and more specifically relates to a tray having a number of compartments in which a tilesetter can keep his tools and materials in an organized manner. The tray may be mounted on the rim of a bucket containing water that is used by the tilesetter, or alternatively the tray will sit in a stable manner on a flat surface such as a floor or counter top.

In U.S. Pat. No. 300,970 issued May 2, 1989 to Walker, there is shown a paint brush holder that is mounted on the rim of a paint can and that supports a paint brush in an upright position along the outside of the paint can. This paint brush holder lacks an extended horizontal upper surface. Because of its narrow width, this paint brush holder would not sit stably on a flat surface. Also, because it includes only one compartment, Walker's paint brush holder would be entirely inadequate for use as a tilesetters tray, where numerous tools and materials must be organized.

In U.S. Pat. No. 1,848,450 issued Mar. 8, 1932 to Williamson and in U.S. Pat. No. 4,561,556 issued Dec. 31, 1985 to Benedicts, there are shown trays that attach to the rim of a bucket by means of legs that extend downwardly along the inside and outside surfaces of the bucket. These trays lack receptacles, and would be of little use to a tilesetter.

In U.S. Pat. No. 2,594,176 issued Apr. 22, 1952 to Kaiser, Jr., there is shown an accessory tray for scrub pails. The tray attaches to the rim of the pail, and includes a single compartment in which a number of items are held.

None of the known prior art trays has a sufficient number of compartment to prove useful to a tilesetter, and none of the prior art trays is capable of sitting in a sueable and stable position on a flat surface as well as when mounted on the rim of bucket.

SUMMARY OF THE INVENTION

It is an objective of the present invention to provide for tilesetters a tray that is useful in organizing a number of tools and materials.

It is a further objective of the present invention to provide a tilesetters tray that can be mounted on the rim of a bucket so that the materials and tools will always be near a supply of water.

It is a further objective of the present invention to provide a tilesetters tray that can be removed from the rim of a bucket and set down on a flat horizontal surface such as a floor or a counter top without toppling over and spilling the materials and tools.

In accordance with the present invention, these objectives are met by the structure of the tray of the present invention which included a horizontal tray that extends almost halfway around the bucket with which it is used and which has a number of receptacles, the three deepest receptacles having the same depth below the horizontal face of the tray and spaced apart so that when removed from the bucket, the tray can rest stably on the bottoms of the three deepest receptacles.

The novel features which are believed to be characteristic of the invention, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
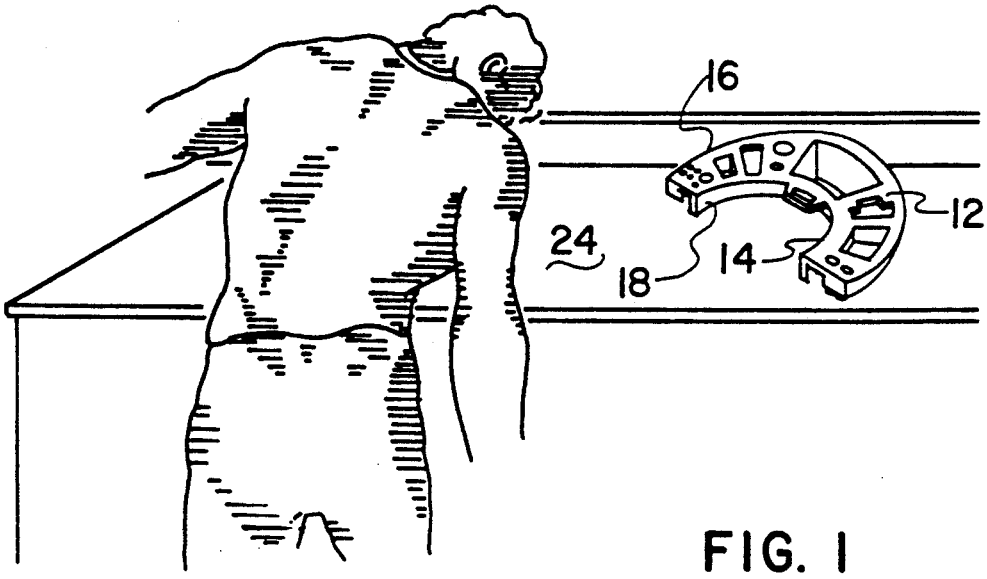
FIG. 1 is a perspective view showing a preferred embodiment of the tilesetters tray of the present invention in use sitting stably on a counter top.
Figure 2:
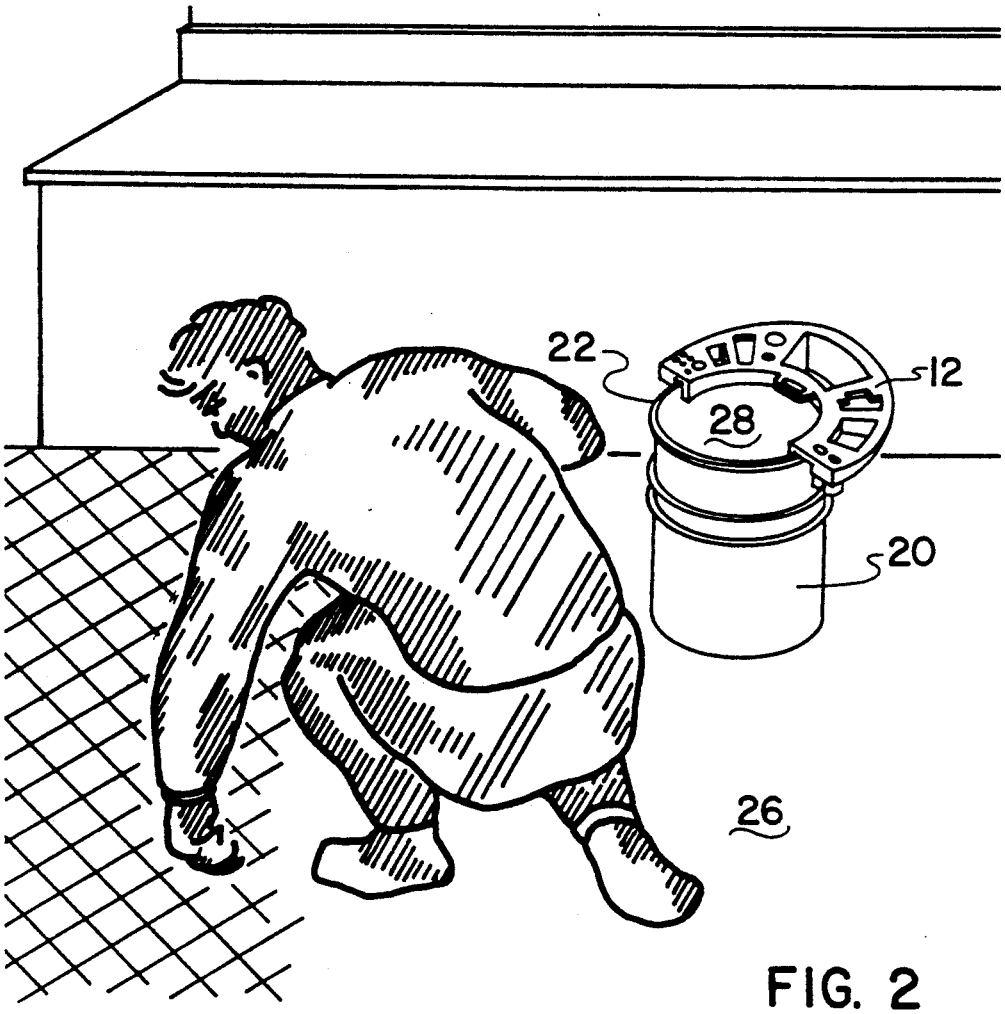
FIG. 2 is a perspective view showing the tilesetters tray of FIG. 1 in use mounted on a bucket.

FIGS. 1 and 2 show the tilesetters tray in use. In FIG. 2 the tray is mounted on a bucket 20 that contains some water, and in FIG. 1, the tray is shown sitting on a flat horizontal counter-top 24.

The tray includes a generally flat top 12 that is bounded on one side by a concave arcuate inner edge 14 and on the other side by a convex outer edge 16. This gives the top of the tray a generally crescent shape. The tray is prevented from slipping off the rim 22 of the bucket 20 by means of a skirt 18 that extends downwardly along the inside surface 28 of the bucket. Although a skirt 18 is used in this preferred embodiment, several spaced tabs are used in an alternative embodiment, and the spaced tabs are considered to be fully equivalent to the skirt 18.

Figure 3:
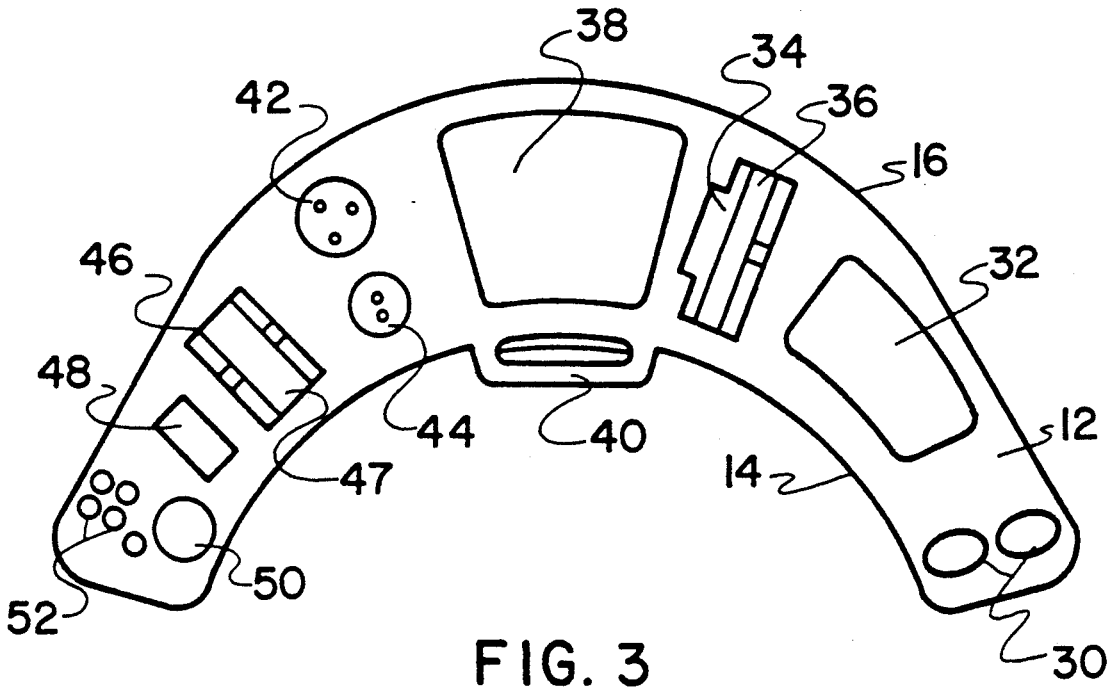
FIG. 3 is a top plan view of the tilesetters tray of FIG. 1.
Figure 4:
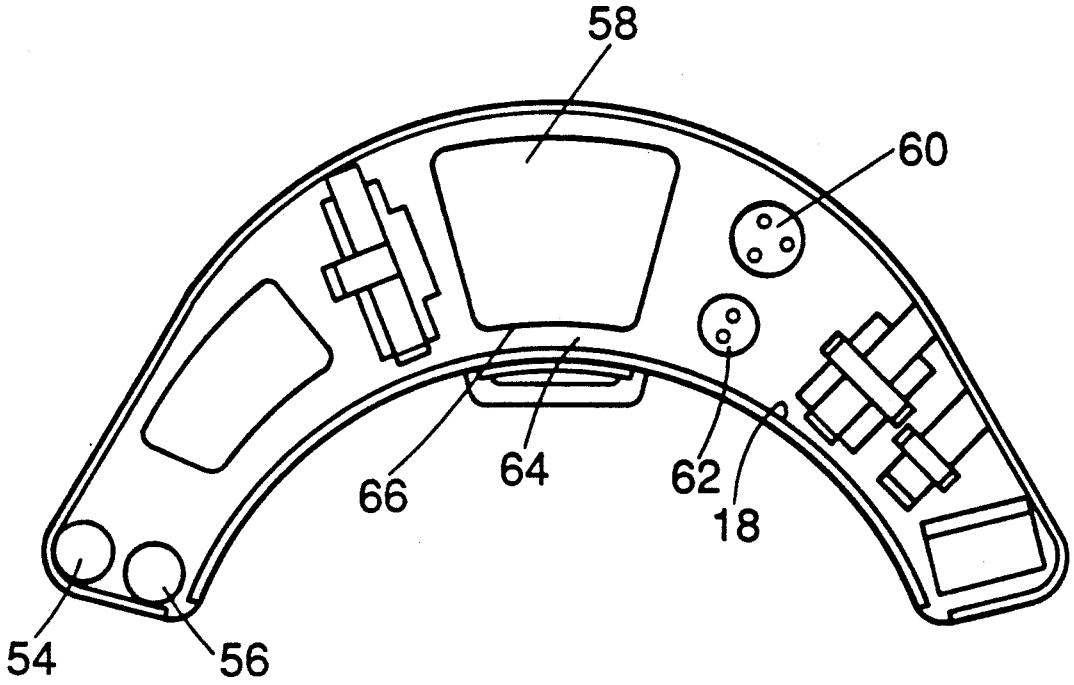
FIG. 4 is a bottom plan view of the tilesetters tray of FIG. 1.

FIG. 3 is a top view of the tilesetters tray, and FIG. 4 is a bottom view. As seen in FIG. 3, the tray includes apertures 30 for receiving the handles of a pair of snips, a receptacle 32 for holding a number of wedges used by a tilesetter, an aperture 34 for receiving a measuring tape. The strap 36 which lies beneath the aperture 34 prevents the measuring tape from falling through the aperture.

The tray also includes a holder 40 for a margin trowel and a receptacle 38 for holding a quantity of tile spacers used by the tilesetter. The receptacles 42 and 44 are used for holding a brush and a scraper respectively. The aperture 46 is for receiving a tile stone, and it is prevented from falling through the aperture by the underlying strap 47 The receptacle 48 is used for a utility knife, and the receptacle 50 is for holding a crayon while the holes 52 are for pencils.

As seen FIG. 4, the bottoms 54, 56, 58, 60, and 62 of the receptacles 30, 38, 42, and 44 respectively are flat and lie in a common plane that is spaced below the face 12. These flat surfaces enable the tray to st in a stable manner upon a flat horizontal surface when the tray has been removed from the bucket 20.

There is a space 64 between the skirt 18 and the wall 66 of the receptacle 38, and the rim 22 of the bucket fits into this space. The wall 66 bears against the outside surface of the bucket to prevent the tray from falling over.

Thus, there has been described a tilesetters tray that includes a number of receptacles for organizing the tools and materials which the tilesetter must have available as he works. The tray can be mounted on the rim of a bucket, and when removed from the bucket the tray will sit stably on a flat surface such as a counter top or floor.

In the preferred embodiment, the tray is composed of a plastic material.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A tilesetters trav that can be removably mounted on the rim of a bucket having an inside surface and an outside surface, comprising:

a top that is generally horizontal and that has a concave arcuate inner edge the radius of which is less than the radius of the rim of the bucket;

a skirt depending from the concave arcuate inner edge of said top and extending downward adjacent the inside surface of the bucket when said tilesetters tray is mounted on the rim of the bucket;

a first receptacle having a bottom that is spaced below said top and connected to said top by a wall, said wall including a portion spaced a particular distance from said skirt so as to extend downward adjacent the outside surface of the bucket when said tilesetters tray is mounted on the rim of the bucket;

a second receptacle having a bottom that lies in a common plane with the bottom of said first receptacle and that is connected to said top by a wall, the wall including a portion spaced a particular distance from said skirt so as to extend downward adjacent the outside surface of the bucket when said tilesetters tray is mounted on the rim of the bucket; and, a third receptacle having a bottom that lies in a common plane with the bottoms of said first and said second receptacles and that is connected to said top by a wall, the wall including a portion spaced a particular distance from said skirt so as to extend downward adjacent the outside surface of the bucket when said tilesetters tray is mounted on the rim of the bucket.

2. A tilesetters tray that can be removably mounted on the rim of a bucket and that also will sit stably on a flat horizontal surface such as a floor or counter top, the bucket having an inside surface and an outside surface, said tilesetters tray comprising:

a top that is generally horizontal and that has a concave arcuate inner edge the radius of which is less than the radius of the rim of the bucket;

a skirt depending from the concave arcuate inner edge of said top and extending downward adjacent the inside surface of the bucket when said tilesetters tray is mounted on the rim of the bucket;

more than one receptacle all having bottoms that lie in a common plane spaced below said top and each connected to said top by its own wall, each wall including a portion spaced a particular distance from said skirt so as to extend downward adjacent the outside of the bucket when said tilesetters tray is mounted on the rim of the bucket.

3. A tilesetters tray that can be removably mounted on the rim of a bucket and that also will sit stably on a flat horizontal surface such as a floor or counter top, the bucket having an inside surface and an outside surface, said tilesetters tray comprising:

a top that is generally horizontal and that has a concave arcuate inner edge the radius of which is less than the radius of the rim of the bucket;

more than one tab depending from the concave arcuate inner edge of said top and extending downward adjacent the inside surface of the bucket when said tilesetters tray is mounted on the rim of the bucket;

more than one receptacle all having bottoms that lie in a common plane spaced below said top and each connected to said top by its own wall, each wall including a portion located a particular radial distance from said more than one tab so as to extend downward adjacent the outside of the bucket when said tilesettes tray is mounted on the rim of the bucket.

* * * * *